US008157561B2

(12) United States Patent
Seo

(10) Patent No.: US 8,157,561 B2
(45) Date of Patent: Apr. 17, 2012

(54) SYSTEM FOR CONTROLLING ATMOSPHERE GAS INSIDE FURNACE

(75) Inventor: Dong Hyun Seo, Ulsan (KR)

(73) Assignee: Hyundai Motor Company, Seoul (KR)

( * ) Notice: Subject to any disclaimer, the term of this patent is extended or adjusted under 35 U.S.C. 154(b) by 841 days.

(21) Appl. No.: 12/290,146

(22) Filed: Oct. 28, 2008

(65) Prior Publication Data

US 2009/0253090 A1 Oct. 8, 2009

(30) Foreign Application Priority Data

Apr. 4, 2008 (KR) ..... 10-2008-0031733

(51) Int. Cl.
*F27B 9/40* (2006.01)

(52) U.S. Cl. ..... 432/37; 432/17

(58) Field of Classification Search ..... 432/14, 432/17, 23, 36, 37
See application file for complete search history.

(56) References Cited

U.S. PATENT DOCUMENTS 4,424,023 A * 1/1984 Matsuoka ..... 432/19
4,781,358 A * 11/1988 Langan ..... 266/80
6,591,215 B1 * 7/2003 Blumenthal et al. ..... 702/130
6,830,606 B2 * 12/2004 Nakao et al. ..... 75/378

FOREIGN PATENT DOCUMENTS

JP 58107408 A 6/1983
JP 60162724 A 8/1985
JP 11131209 A * 5/1999

* cited by examiner

*Primary Examiner* — Gregory A Wilson
(74) *Attorney, Agent, or Firm* — Edwards Wildman Palmer LLP; Peter F. Corless

(57) ABSTRACT

A system for controlling atmospheric gas inside a furnace may include a furnace into which an atmospheric gas is charged for thermaltreating carbon steel, a flow control portion that is connected to the furnace for controlling the flow of the atmospheric gas, a gas generator for producing an endothermic gas (Rx gas) and supplying the flow control portion with the endothermic gas, and a gas analyzing control portion for analyzing the atmospheric gas that is supplied through a sampling line that is connected to the furnace and for controlling the flow control portion based on the analyzed data so as to control a flux of the atmospheric gas that is supplied to the furnace. With the system, decarbonization of carbon steel can be prevented or reduced.

6 Claims, 3 Drawing Sheets

SYSTEM FOR CONTROLLING ATMOSPHERE GAS INSIDE FURNACE

CROSS-REFERENCE TO RELATED APPLICATION

This application claims priority to and the benefit of Korean Patent Application No. 10-2008-0031733 filed on Apr. 4, 2008, the entire contents of which are incorporated herein by reference.

BACKGROUND (a) Technical Field

The present disclosure relates to a furnace for treating carbon steel with heat, and more particularly to a system for controlling atmospheric gas that is supplied into the furnace.

(b) Background Art

When oxygen flows into a heat treatment furnace or oxygen is generated therein, the oxygen reacts with the carbon steel in the furnace to decarbonize the carbon steel. The decarbonization lowers the dimensional precision of the steel product.

The decarbonization is a phenomenon in which carbon steel reacts with oxygen at a high temperature and the carbon of the carbon steel is removed as CO or $CO_2$ so that the carbon concentration of the steel surface is reduced, thereby transforming the carbon steel to a soft ferrite material.

The decarbonization may lower the hardness of the steel product. It also may generate tensile stress in a surface portion of the carbon steel, causing a deformation thereof or a crack therein. One method to reduce the decarbonization is to supply the heat treatment furnace with an atmospheric gas such as nitrogen and an endothermic gas.

However, when the contents of outside air, oxygen, carbon dioxide, vapor, or sulfur dioxide is higher than that in an equilibrium condition within the furnace while the atmospheric gas is supplied to the furnace, decarbonization occurs therein.

The above information disclosed in this Background section is only for enhancement of understanding of the background of the invention and therefore it may contain information that does not form the prior art that is already known in this country to a person of ordinary skill in the art.

SUMMARY

The present invention has been made in an effort to provide a system for controlling atmospheric gas inside a furnace having advantages of preventing decarbonization of carbon steel that is treated with heat in the furnace.

A system for controlling atmospheric gas inside a furnace may include a furnace for treating carbon steel with heat at a predetermined temperature and into which an atmospheric gas is charged, a flow control portion that is connected to the furnace for controlling the flow of the atmospheric gas that is supplied to the furnace, a gas generator for producing an endothermic gas (Rx gas) and supplying the flow control portion with the endothermic gas, and a gas analyzing control portion that analyzes the atmospheric gas that is supplied through a sampling line that is connected to the furnace and that controls the flow control portion based on the analyzed data so as to control a flux of the atmospheric gas that is supplied to the furnace.

The flow control portion may include a first supply line through which nitrogen gas passes and a second supply line through which the endothermic gas passes, and a solenoid valve or a control valve that is controlled by the gas analyzing control portion is disposed on the first supply line and the second supply line.

The first supply line may include a solenoid valve that is opened during a power failure, and a control valve that is PID-controlled according to a PF value that is analyzed in the gas analyzer.

The gas generator may use LNG to produce the endothermic gas, the gas analyzing control portion analyzes the CO2 amount of the endothermic gas, and the gas analyzing control portion determines whether the CO2 amount is in a predetermined range.

The gas analyzing control portion may include a gas sensor for analyzing carbon monoxide, carbon dioxide, or oxygen, a PF calculator that calculates a PF value based on signals that are detected by the gas sensor, and a control portion that compares the calculated PF value with a predetermined PF value so as to control the control valve of the flow control portion.

The gas analyzing control portion may analyze contents of the endothermic gas that is produced in the gas generator to determine the performance of the gas generator.

The atmospheric gas within the furnace is sampled to be analyzed, and the inflow amount of the atmospheric gas that is supplied into the furnace is controlled based on the analyzed data so as to reduce the decarbonization according to the system for controlling atmospheric gas inside the furnace of an exemplary embodiment of the present invention.

The above and other features will be discussed infra.

DESCRIPTION OF REFERENCE NUMERALS INDICATING PRIMARY ELEMENTS IN THE DRAWINGS

Figure 1:
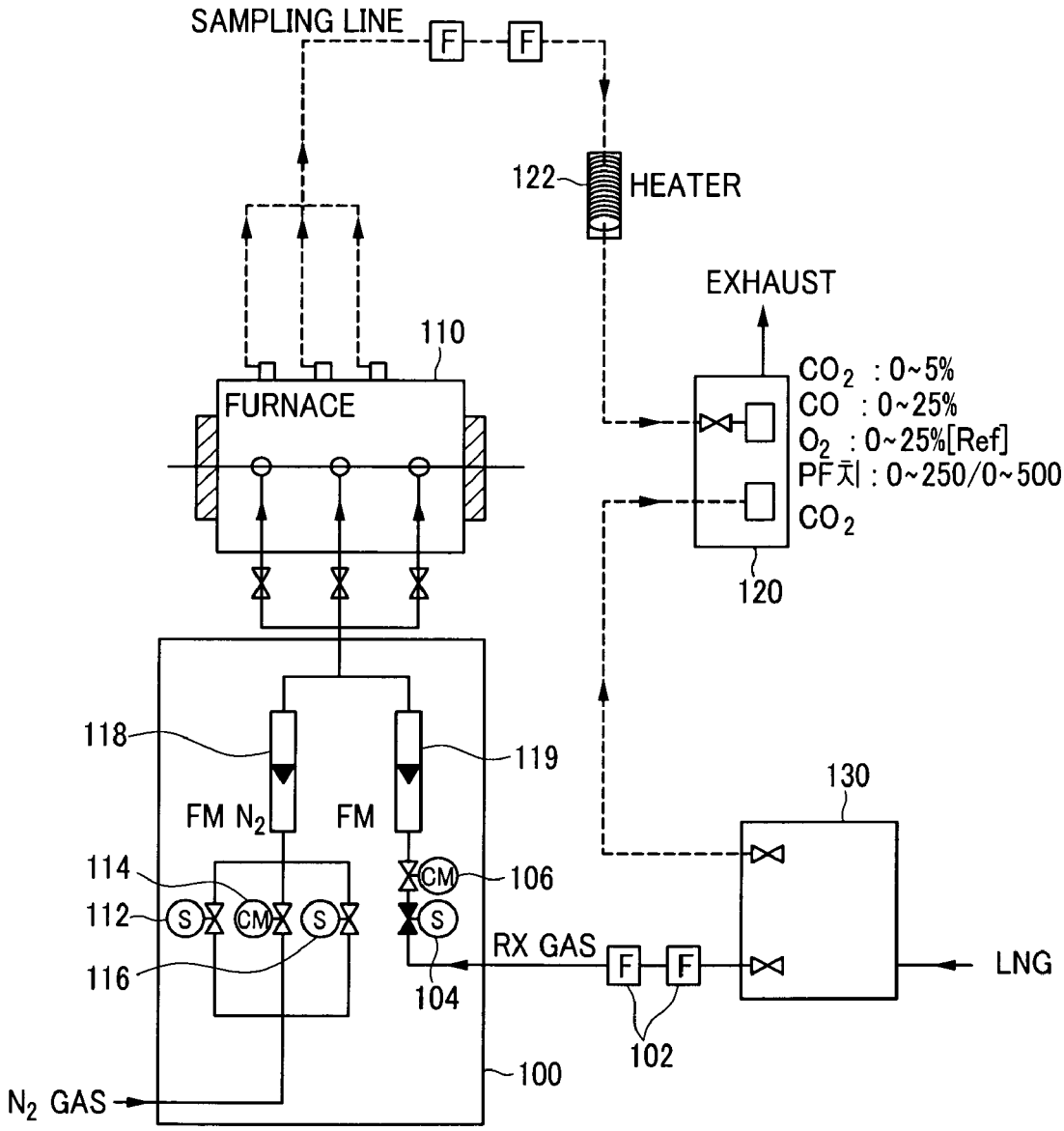
FIG. 1 is a schematic diagram of a system for controlling an atmospheric gas inside a spheroidizing heat treatment furnace according to an exemplary embodiment of the present invention.

100: flow control portion
102: fire check valve
104, 112, 116: solenoid valve
114, 106: control valve
118, 119: flow meter
120: gas analyzing control portion
122: heater
130: gas generator
200: LNG flow meter
202: filter
204: air flow meter
206: blower
208: retort
210: cooler
300: chamber (furnace)
302: gas analyzer
304: AC/DC converter
306: PF calculator
308: PI calculator
310: controller

312: throttle position controller
314: valve controller
316, 318: control motor

DETAILED DESCRIPTION

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

FIG. 1 is a schematic diagram of a system for controlling an atmospheric gas inside a spheroidizing heat treatment furnace according to an exemplary embodiment of the present invention.

Referring to FIG. 1, the atmospheric gas control system includes a furnace 110, a flow control portion 100, a gas analyzing control portion 120, and a gas generator 130.

The inside of the furnace 110 is heated to a predetermined temperature (about 770° C.) so as to heat-treat the carbon steel therein, and the inside thereof is filled with an atmospheric gas so as to reduce decarbonization of the carbon steel.

A supply line is suitably disposed to supply the atmospheric gas into the furnace 110, and a sampling line is suitably disposed to exhaust the atmospheric gas to the outside of the furnace 110.

Preferably, the flow control portion 100 includes a first supply line for supplying nitrogen gas and a second supply line for supplying an endothermic gas.

Flow meters 118 and 119 may suitably be disposed on the first supply line and the second supply line, respectively. The flow meters 118 and 119 are used to precisely control the gas that is supplied and generate an alarm signal when there is a power failure. Also, solenoid valves 112, 116, and 104 and control valves 114 and 106 may suitably be disposed in the first supply line and the second supply line, respectively.

The solenoid valve 116 is closed in a normal condition and may be opened when the electricity is off. The solenoid valve 112 is open. Accordingly, the atmospheric gas is securely supplied into the furnace 110. Also, the opening rate of the control valve 114 is properly controlled in a range from 0 to 100% according to the content amount of the atmospheric gas within the furnace 110.

The gas generator 130 may produce endothermic gas, and the produced endothermic gas is supplied into the furnace 110 through the second supply line of the flow control portion 100.

The opening rate of the control valve 106 is adequately controlled in a range from 0 to 100% according to the state of the atmospheric gas within the furnace 110.

The atmospheric gas is supplied to the gas analyzing control portion 120 via the sampling line that is connected to the furnace 110 through a heater 122. A fire check valve 102 may suitably be disposed on a line between the flow control portion 100 and the gas generator.

The gas analyzing control portion 120 analyzes the supplied atmospheric gas. According to an embodiment, the gas analyzing control portion 120 analyzes the content amounts of carbon dioxide, carbon monoxide, and oxygen, and controls the flow control portion 100 based on the information about the content amounts.

Also, the gas analyzing control portion 120 receives the endothermic gas (Rx gas) that is produced from the gas generator 130 and analyzes the amount of the carbon dioxide that is included in the endothermic gas.

The gas analyzing control portion 120 analyzes the contents of the atmospheric gas to effectively control the opening rates of the control valves 114 and 106 and the solenoid valves 112, 116, and 104 of the flow control portion 100 based on the information about the analyzed contents.

Preferably, the gas analyzing control portion 120 may calculate a PF value and PID-control (Proportional Integral Differential control) the valves (112, 114, 116, 106, and 104) to effectively supply the atmospheric gas into the furnace and reduce decarbonization.

The gas analyzing control portion 120 analyzes the content of the carbon dioxide that is included in the endothermic gas to detect the performance of the gas generator 130.

Fire check valves (F) may suitably be disposed between the gas generator 130 and the flow control portion 100 and between the furnace 110 and the gas analyzing control portion 120.

Figure 2:
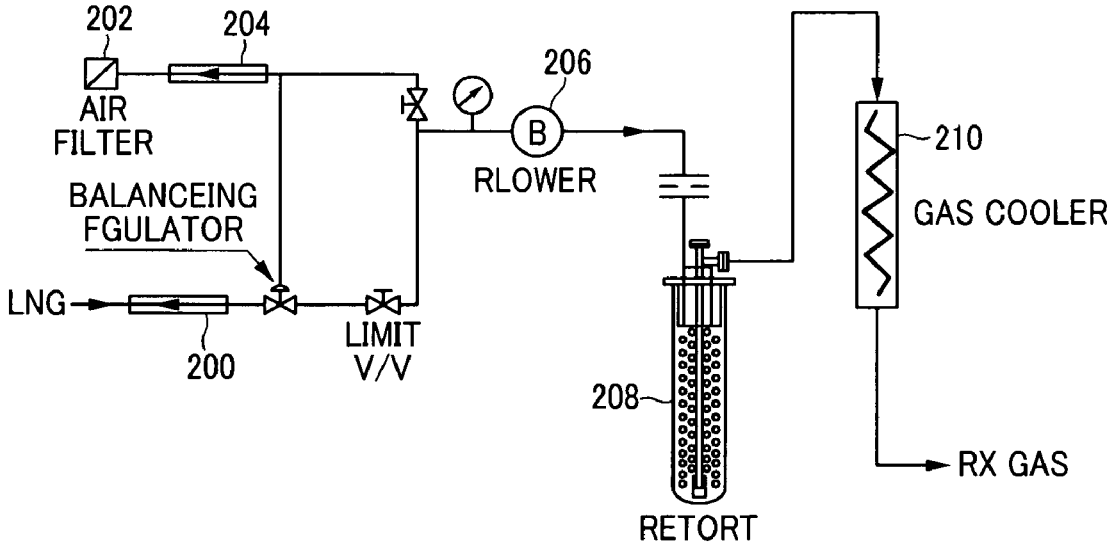
FIG. 2 is a schematic diagram of a gas generator according to an exemplary embodiment of the present invention.

FIG. 2 is a schematic diagram of a gas generator according to an exemplary embodiment of the present invention.

The gas generator 130 mixes LNG with air in a proper ratio to produce the endothermic gas (Rx gas). The gas generator 130 may suitably include an LNG flow meter 200 for detecting a flux of the LNG, an air filter 202, an air flow meter 204, a blower 206, a retort 208, and a cooler 210. A detailed description of the gas generator 130 will be omitted in the present exemplary embodiment.

A portion of the endothermic gas that is generated from the gas generator 130 is analyzed in the gas analyzing control portion 120 to detect the performance of the gas generator 130.

Figure 3:
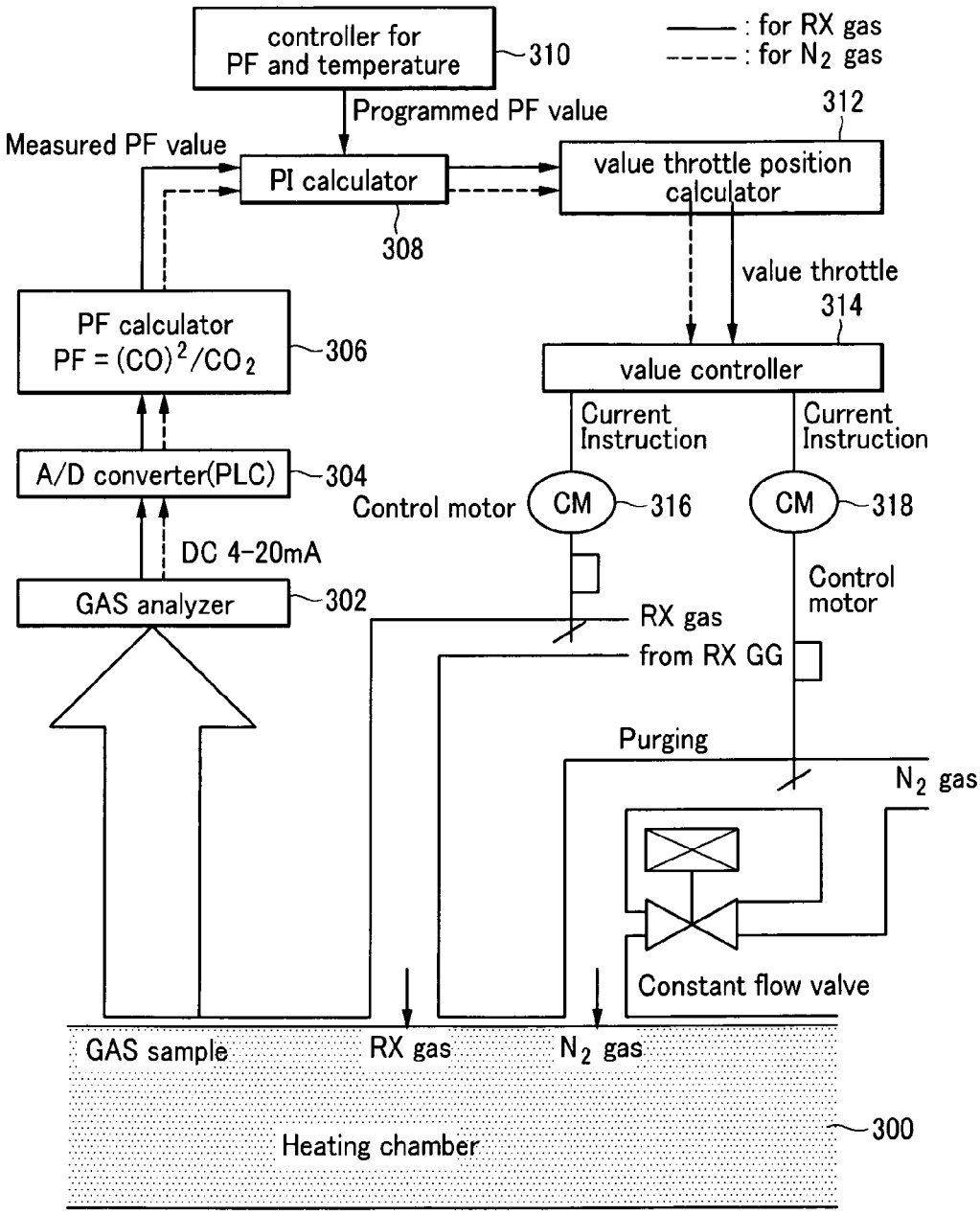
FIG. 3 is a control flow chart of an a system for controlling an atmospheric gas inside a spheroidizing heat treatment furnace according to an exemplary embodiment of the present invention.

FIG. 3 is a control flow chart of a system for controlling an atmospheric gas inside a spheroidizing heat treatment furnace according to an exemplary embodiment of the present invention.

Referring to FIG. 3, the gas control system that is installed in a chamber 300 of the furnace, suitably, includes a gas analyzer 302, an AC/DC converter 304, a PF calculator 306, a PI (Proportional Integral) calculator 308, a controller 310, a throttle position controller 312, a valve controller 314, and control motors 316 and 318.

The constituents of the atmospheric gas sample that is supplied from the chamber 300 of the furnace are analyzed in the gas analyzer 302. Also, the gas analyzer 302 outputs a DC current according to the conditions of the analyzed gas.

The AC/DC converter 304 transforms to an AC current the DC current that is outputted from the gas analyzer 302. The gas analyzer 302 may preferably include a carbon dioxide sensor, a carbon monoxide sensor, and an oxygen sensor.

The PF calculator 306 calculates a PF value based on the current value that is transferred from the AC/DC converter 304. Also, the PI calculator 308 compares the PF value that is transferred from the PF calculator 306 with a predetermined PF value of the controller 310 to calculate a PI value.

The throttle position controller 312 transmits an operation current to the valve controller 314 according to the PI value that is transferred from the PI calculator 308.

The valve controller 314 operates the control motors 316 and 318 according to the operation current that is transferred from the throttle position controller 312.

Accordingly, the control motor 316 that is disposed in the endothermic gas supply line and the control motor 318 that is disposed in the nitrogen supply line are adequately controlled based on the contents of the atmospheric gas of the chamber 300 in the control process that is stated above.

Referring to FIG. 1 and FIG. 3, suitably, the gas analyzing control portion 120 controls the carbon dioxide to be in a range of 0 to 5%, and controls the carbon monoxide to be in a range of 0 to 25% among the atmospheric gas within the furnace 110. Also, the gas analyzing control portion 120 controls the oxygen to be in a range of 0 to 25%.

For example, when the carbon dioxide or the oxygen value is raised, the supply amount of the nitrogen or the endothermic gas is raised to reduce the decarbonization reaction.

Preferably, the PF value that is calculated in the PF calculator 306 is controlled to be in a range of 0 to 250 or 0 to 500. Also preferably, the gas analyzing control portion 120 analyzes the content of the carbon dioxide that is included in the endothermic gas produced in the gas generator 130 to determine the performance of the gas generator 130 and to control production amount.

With regard to the PF value, for example, carburization occurs in some degrees when the PF value is larger than 65 and decarbonization occurs when the PF value is lower than 65. Generally, as the temperature becomes higher, the PF value also becomes higher.

While this invention has been described in connection with what is presently considered to be practical-exemplary embodiments, it is to be understood that the invention is not limited to the disclosed embodiments, but, on the contrary, is intended to cover various modifications and equivalent arrangements included within the spirit and scope of the appended claims.

What is claimed is:

1. A system for controlling atmospheric gas inside a furnace, comprising:

a furnace into which an atmospheric gas is charged for treating carbon steel with heat at a predetermined temperature;

a flow control portion that is connected to the furnace for controlling the flow of the atmospheric gas that is supplied to the furnace;

a gas generator for producing an endothermic gas (Rx gas) and supplying the flow control portion with the endothermic gas; and a gas analyzing control portion that analyzes the atmospheric gas that is supplied through a sampling line that is connected to the furnace and that controls the flow control portion based on the analyzed data so as to control a flux of the atmospheric gas that is supplied to the furnace.

2. The system for controlling atmospheric gas of claim 1, wherein the flow control portion comprises:

a first supply line through which nitrogen gas passes;

a second supply line through which the endothermic gas passes; and a solenoid valve or a control valve that is controlled by the gas analyzing control portion and that is disposed on the first supply line and the second supply line.

3. The system for controlling atmospheric gas of claim 2, wherein the first supply line comprises:

a solenoid valve that is opened during a power failure; and a control valve that is PID-controlled according to a PF value that is analyzed in the gas analyzer.

4. The system for controlling atmospheric gas of claim 1, wherein the gas generator uses LNG to produce the endothermic gas, the gas analyzing control portion analyzes the $CO_2$ amount of the endothermic gas, and the gas analyzing control portion determines whether the $CO_2$ amount is in a predetermined range.

5. The system for controlling atmospheric gas of claim 1, wherein the gas analyzing control portion comprises:

a gas sensor for analyzing carbon monoxide, carbon dioxide, and oxygen;

a PF calculator that is used to calculate a PF value based on signals that are detected by the gas sensor; and a control portion that compares the calculated PF value with a predetermined PF value so as to control the control valve of the flow control portion.

6. The system for controlling atmospheric gas of claim 1, wherein the gas analyzing control portion analyzes contents of the endothermic gas that is produced in the gas generator to determine the performance of the gas generator.

* * * * *